US006887109B2

(12) United States Patent
Hofmeister et al.

(10) Patent No.: US 6,887,109 B2
(45) Date of Patent: May 3, 2005

(54) ELECTRICAL ADAPTER FOR PROTECTING ELECTRICAL INTERFACES

(75) Inventors: Rudolf J. Hofmeister, Sunnyvale, CA (US); Samantha R. Bench, Whitefish, MT (US)

(73) Assignee: Finisar Corporation, Sunnyvale, CA (US)

( * ) Notice: Subject to any disclaimer, the term of this patent is extended or adjusted under 35 U.S.C. 154(b) by 0 days.

(21) Appl. No.: 10/695,346

(22) Filed: Oct. 28, 2003

(65) Prior Publication Data

US 2004/0087216 A1 May 6, 2004

Related U.S. Application Data

(60) Provisional application No. 60/422,204, filed on Oct. 29, 2002.

(51) Int. Cl.[7] ..... H01R 9/09
(52) U.S. Cl. ..... 439/638; 439/71; 324/755
(58) Field of Search ..... 439/638, 39, 71, 439/12, 684; 324/755

(56) References Cited

U.S. PATENT DOCUMENTS 3,740,697 A * 6/1973 Van Son ..... 439/468
4,733,461 A * 3/1988 Nakano ..... 29/830
5,089,880 A * 2/1992 Meyer et al. ..... 257/692
5,151,039 A * 9/1992 Murphy ..... 439/70
5,257,166 A * 10/1993 Marui et al. ..... 361/760
5,329,418 A * 7/1994 Tanabe ..... 361/695
5,334,875 A * 8/1994 Sugano et al. ..... 257/686
5,575,686 A * 11/1996 Noschese ..... 439/620
5,580,262 A * 12/1996 Kubota et al. ..... 439/189
5,707,242 A * 1/1998 Mitra et al. ..... 439/74
6,077,091 A * 6/2000 McKenna-Olson et al. ... 439/71
6,319,066 B2 * 11/2001 Kuo ..... 439/638
6,464,513 B1 * 10/2002 Momenpour et al. ..... 439/73
2002/0000816 A1 * 1/2002 Lin et al. ..... 324/755
2003/0181071 A1 * 9/2003 Weiss et al. ..... 439/55

FOREIGN PATENT DOCUMENTS

JP 05-234649 * 9/1993
JP 05-242940 * 9/1993

* cited by examiner

*Primary Examiner*—Michael C. Zarroli
(74) *Attorney, Agent, or Firm*—Workman Nydegger

(57) ABSTRACT

An electrical adapter is provided including a board having first and second planar surfaces, a male electrical socket coupled to the first planar surface of the printed circuit board and a female electrical socket coupled to the second planar surface of the printed circuit board. The board includes electrical connectors electrically coupling the male and female electrical sockets. The male electrical socket of the adapter is suitable for temporary connection to a female electrical interface of a first electrical device, and the female electrical socket is suitable for temporary connection to a male electrical interface of a second electrical device. The opposing socket is suitable for temporary connection to a printed circuit board. In one embodiment, the electrical device is an optoelectronic device.

12 Claims, 5 Drawing Sheets

ELECTRICAL ADAPTER FOR PROTECTING ELECTRICAL INTERFACES

RELATED APPLICATIONS

This application claims priority to U.S. Provisional Application Ser. No. 60/422,204, filed Oct. 29, 2002 and entitled "ELECTRICAL INTERFACE ADAPTER FOR TRANSCEIVER AND TESTER EVALUATION BOARD," which application is incorporated herein by reference in its entirety.

BACKGROUND OF THE INVENTION

1. The Field of the Invention

The present invention relates generally to electrical adapters for protecting electrical connections of various electrical devices and/or optoelectronic devices, such as transceivers, transponders, and transmitters. More particularly, the present invention relates to an electrical adapter than can be placed between an electrical and/or optoelectronic device and a testing device which prolongs the life of the electrical interface on the electrical/optoelectronic device and/or testing device which may have fragile electrical interfaces.

2. The Relevant Technology

The electrical interfaces of many electrical and/or optoelectronic devices are quite strong, able to withstand large numbers or insertions and removals to and from the complementary interfaces of other devices. However, some electrical interfaces, such as the OIF99.102.8, are more fragile. The OIF99.102.8 interface is composed of small pins known as leaves and blades. The female side of the connector contains leaves. Each leaf is a pair of pins that act together as a spring-like mechanism for holding a "blade" of a complementary interface. Each blade is a single pin, slightly wider and shorter pin than the individual pins of the leaves. Each blade is designed to fit between a pair of leaf pins.

The leaves of such interfaces are typically more easily bent or damaged than the blades. A "lifetime" rating may be associated with the female side of the interface, indicating the number of insertions and removals the female side of the interface is likely to withstand before at least one leaf is damaged, making the interface unusable. For instance, the female side of the interface may have a lifetime rating of as few as 30 insertions and removals, indicating that most interfaces will withstand at least 30 insertions and removals, although some may fail after fewer insertions and removals.

When transceivers, transponders, and transmitters are expensive, the limited life of the electrical interface can result in a significant waste of resources. Because the electrical interface is often the first thing to break, an otherwise fully functional transponder may require expensive repair or may need to be replaced entirely when the only defect in the transceiver, transponder, and transmitter is a broken electrical interface.

During manufacturing, most optoelectronic devices, including transceivers, transponders, and transmitters, are made with electrical interfaces that are able to withstand the maximum number of insertions and removals that can be expected of electrical interfaces with pins that are small and fragile by nature. However, as a matter of statistics, it is inevitable that some electrical interfaces will be manufactured with pins that will break particularly easily, thus rendering the optoelectronic device unusable after a relatively few number of insertions and removals. For optoelectronic devices with these particularly fragile interfaces, the ability to reduce the total number of insertions and removals required to use the optoelectronic device may result in a significantly longer life for the device.

A similar problem arises with testers. Electrical interfaces of testers are typically less fragile than those of transponders and transceivers, but they nevertheless have a limited lifetime in terms of insertions and removals. As a result, a tester may be used to test a limited number of transponders before the electrical interface on the tester's evaluation board will likely break. When a tester, or the evaluation board of the tester, is particularly expensive, the result is that expensive repair or replacement costs may need to be incurred in order to fix an otherwise fully functional tester or evaluation board.

SUMMARY OF THE INVENTION

In summary, the present invention is an electrical adapter designed to reduce the wear and tear on electrical and/or optoelectronic devices having fragile electrical interfaces. By securing the fragile electrical interface of an electrical/optoelectronic device to a relatively inexpensive electrical adapter with an electrical interface corresponding to that of the device, and then connecting the electrical adapter to multiple testers, the number of insertions of the electrical interface of the electrical/optoelectronic device is reduced to just one insertion. The wear and tear on the electrical interface of the device is thereby reduced.

As used herein, the term "electrical device" includes "optoelectronic devices" and, thus, the two terms may be used interchangeably. While optoelectronic devices include optical components as well as electrical components, for purposes of this specification and claims, optoelectronic devices are a subgroup of the broad category of electrical devices, because the electrical adapter is used with the electrical components of the optoelectronic device. Thus, for purposes of this specification, an optoelectronic device will be used in exemplary embodiments, although it will be understood that the electrical adapter may be used for any other electrical device.

The electrical adapter includes a board having first and second planar surfaces, a male electrical socket coupled to the first planar surface of the printed circuit board and a female electrical socket coupled to the second planar surface of the printed circuit board. The male electrical socket of the adapter is suitable for temporary connection to a female electrical interface of a first electrical device, and the female electrical socket is suitable for temporary connection to a male electrical interface of a second electrical device. The board includes electrical connections coupling the male and female electrical sockets.

In another aspect of the invention, a method is provided for testing an electrical device having an electrical interface. An electrical adapter is temporarily connected to the electrical interface of the electrical device. While maintaining the temporary connection of the electrical adapter to the electrical interface of the electrical device, the electrical device is coupled to a tester by coupling a second electrical interface of the adapter to a complementary electrical interface of the tester. Using the tester, a test is performed on the electrical device, then the electrical device is disconnected from the tester by disconnecting the electrical interface of the electrical adapter from the electrical interface of the tester. While maintaining the temporary connection of the electrical adapter to the electrical interface of the electrical device, the processes of connecting, testing, and disconnecting are repeated for a plurality of distinct testers.

In yet another aspect of the invention, a method is provided for preserving the electrical interface of a tester. An electrical adapter is temporarily connected to an electrical interface of the tester. While maintaining the temporary connection of the tester to the electrical adapter, the tester is coupled to an electrical device by coupling a second electrical interface of the electrical adapter to a complementary electrical interface of the electrical device. The electrical device is then tested using the tester. The tester is then disconnected from the electrical device by disconnecting the electrical interface of the electrical adapter on the tester from the electrical interface of the electrical adapter of the electrical device. While maintaining the temporary connection of the electrical adapter to the electrical interface of the tester, the processes of connecting, testing, and disconnecting are repeated for a plurality of distinct electrical devices.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF THE PREFERRED EMBODIMENTS

The present invention provides an inexpensive electrical adapter used to reduce damage to an electrical interface of an expensive electrical device and/or optoelectronic device. As used herein, the term "electrical device" includes "optoelectronic devices" and, thus, the two terms may be used interchangeably. While optoelectronic devices include optical components as well as electrical components, for purposes of this specification and claims, optoelectronic devices are a subgroup of the broad category of electrical devices, because the electrical adapter is used with the electrical components of the optoelectronic device. Thus, for purposes of this specification, an optoelectronic device will be used in exemplary embodiments, although it will be understood that the electrical adapter may be used for any other electrical device.

When used, an electrical/optoelectronic device's electrical interface is typically inserted into and removed from corresponding and opposing gender electrical interfaces on other devices numerous times. These repeated insertions and removals can damage the fragile electrical interface of the electrical/optoelectronic device. By connecting an electrical adapter to the electrical/optoelectronic device, the coupled adapter and electrical/optoelectronic device can be repeatedly coupled to another device while only damaging the electrical interface of the inexpensive adapter.

Figure 1:
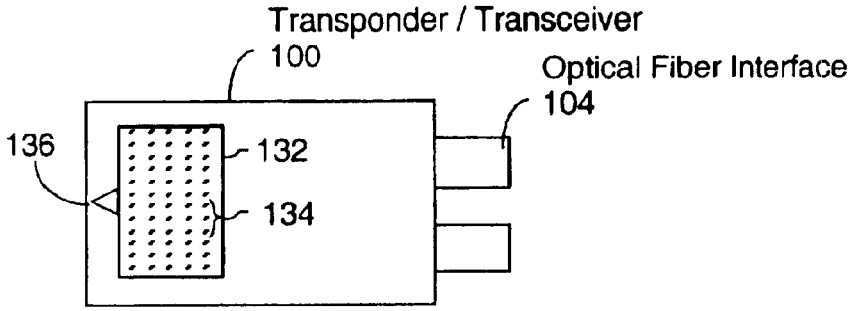
FIG. 1 illustrates is a schematic top view of a transceiver or transponder.

FIG. 1 is a schematic top view of a transceiver or transponder (hereafter "transceiver"). The transceiver 100 is any standard operating transceiver or transponder, such as the Integrated DWDM Transponder for OC-192/STM-64 with FEC or 10 GbE. The transceiver includes an optical interface 104 for receiving information sent to the transceiver 100 as well as an electrical socket 132 for connecting the transceiver to electrical devices having corresponding and opposing gender electrical interfaces. The electrical socket 132 typically includes pins 134 configured to be inserted into another electrical interface having an opposing gender. The electrical socket 132 is preferably keyed with a key 136 so that only a complementary electrical interface having a complementary key and oriented in a single direction may be coupled to it.

Figure 2A:
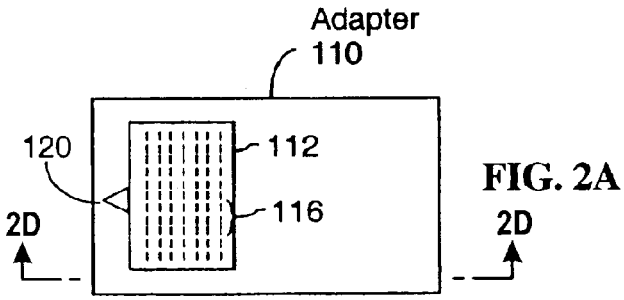
FIG. 2A is a schematic top view of an electrical adapter.
Figure 2B:
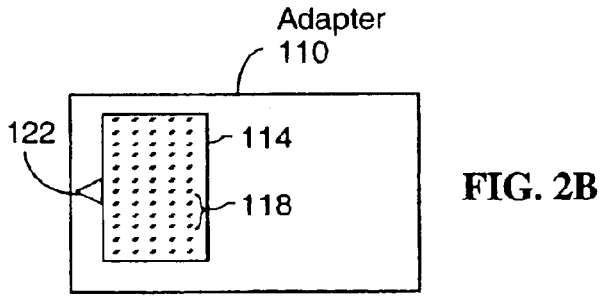
FIG. 2B is a schematic bottom view of the electrical adapter shown in FIG. 2A.
Figure 2C:
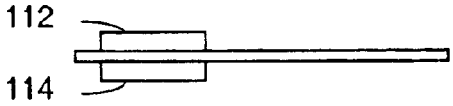
FIG. 2C is a side view of the electrical adapter shown in FIG. 2A.

FIG. 2A is a schematic top view of an electrical adapter. FIG. 2B is a schematic bottom view of the electrical adapter shown in FIG. 2A. FIG. 2C is a side view of the electrical adapter shown in FIG. 2A.

The adapter 110 includes a generally planar board member 110 having first and second planar surfaces. Adapter 110 also includes an electrical interface 112 on one side of the board and an opposing electrical interface 114 on the opposing side of the board. The board member 110 may be any suitable material which provides sufficient strength to support electrical interfaces 112, 114. In one embodiment, the board member 110 is a printed circuit board (e.g., silicon material). Board member 100 provides an electrical connection for interfaces 112 and 114. A piece of metal or plastic may be used to support the board member 100.

The electrical interfaces 112, 114 are electrically coupled together using features of the planar member of the adapter 110. Electrical interface 112 and/or 114 is configured to electrically couple to the corresponding socket 132 of an external electrical devices, such as transceiver 100. Like the electrical socket 132 of the transceiver 100, the electrical interfaces 112 and/or 114 of the adapter 110 are keyed 120 and/or 122 so that only an interface having a corresponding gender may be coupled with it.

In the embodiment of FIGS. 2A and 2B, the electrical interface 112 forms a male socket and the electrical interface 114 forms a female socket. That is, electrical interface 112 includes pins 116 in the form of blades, which form a male interface. In contrast, the electrical interface 114 includes pins 118 in the form of leaves, which form a female interface. Each leaf is a pair of pins 118 that act together as a spring-like mechanism for holding a "blade" of a complementary interface. Each blade is a single pin 116, slightly wider and shorter than the individual pins 118 of the leaves. Each blade is designed to fit between a pair of leaf pins 118. The electrical interfaces 112, 114 can be formed on printed circuit board 110 by means understood to those skilled in the art.

It will be appreciated that the orientation of male socket 112 and female socket 114 on adapter 110 may be varied so that the female socket 114 is on top and the male socket 112 is on the bottom of adapter 110. The pins 116, 118 of adapter 110 are electrically coupled. In one embodiment, pins 116, 118 are electrically coupled, for example, in one embodiment, through their ball grid array 117 to metal traces 119 formed on one or both planar sides of board 110.

Figure 3:
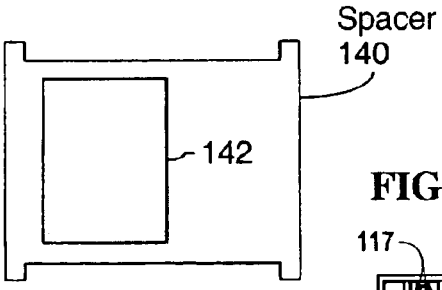
FIG. 3 is a top view of a spacer for use with the preferred embodiment.
Figure 2D:
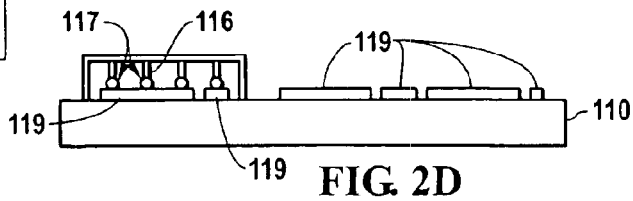
FIG. 2D is a section view taken from FIG. 2A and illustrates the use of a ball grid array ("BGA") to electrically connect pins of a male socket to traces of a printed circuit board of an exemplary electrical adapter.

FIG. 3 is a spacer 140 having a generally planar body. Each spacer 140 includes an aperture 142 formed in the body through which an electrical interface or socket 132 (FIG. 1), 112 (FIG. 2A), 114 (FIG. 2B), or 220 (FIG. 4C) of a transceiver 100 (FIG. 1), adapter 110 (FIG. 2A), or evaluation board 210 (FIG. 4C) of a tester 200 (FIG. 4C) will fit. Further details of use of the spacer 140 and tester 200 are described below.

Figure 4A:
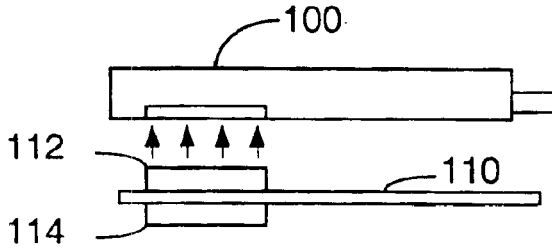
FIG. 4A is a side view of an electrical adapter of FIGS. 2A, 2B, and 2C being coupled to the transceiver of FIG. 1.
Figure 4B:
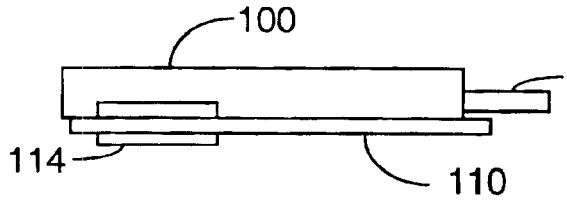
FIG. 4B is a side view of an electrical adapter of FIGS. 2A, 2B, and 2C coupled to the transceiver of FIG. 1.
Figure 4C:
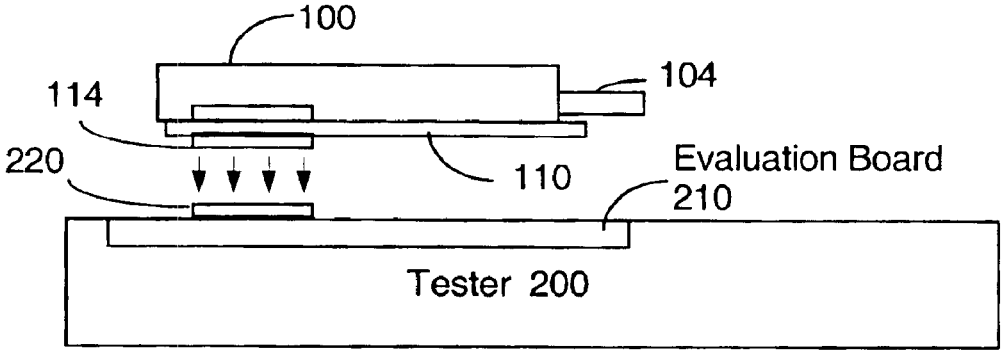
FIG. 4C is a side view of a coupled transceiver and electrical adapter being coupled to a tester.
Figure 4D:
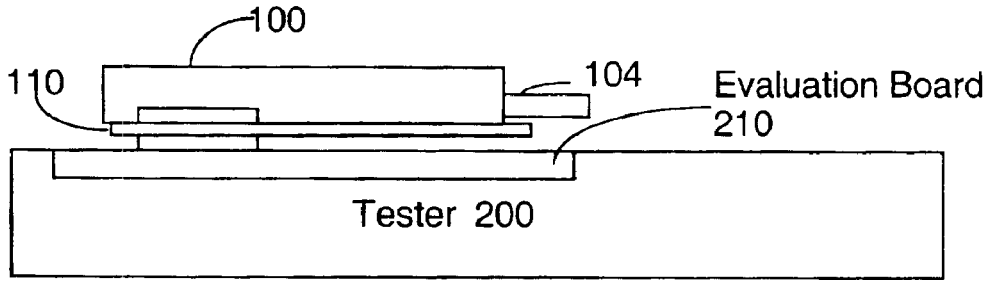
FIG. 4D is a side view of a transceiver, an electrical adapter, and tester coupled to one another.

FIG. 4A illustrates a side view of an electrical adapter of FIGS. 2A, 2B, and 2C being coupled to the transceiver of FIG. 1, and FIG. 4B shows a view of these pieces after coupling. In FIG. 4C, these pieces are being coupled to a tester. FIG. 4D illustrates the electrical adapter, transceiver, and tester all coupled together. As shown in FIG. 4A, an electrical adapter 110 is inserted into a transceiver 100 by coupling the electrical interface 112 of an adapter 110 to the complementary and opposing gender electrical socket 132 (FIG. 1) of a transceiver 100. This coupling is generally indicated by the arrows.

Figure 4E:
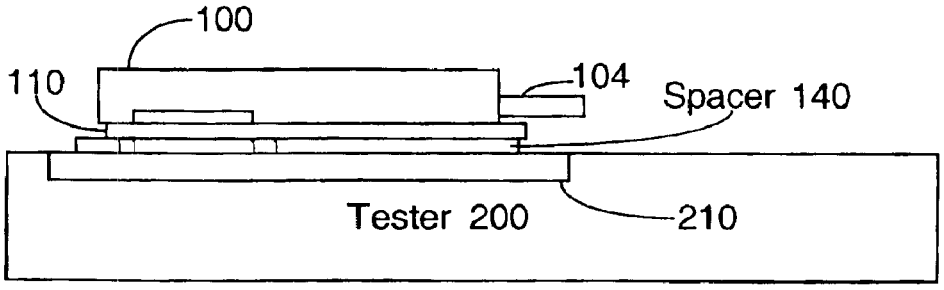
FIG. 4E is a side view of a transceiver, electrical adapter, tester, and spacer coupled to one another.

In FIG. 4B, a transceiver 100 and an adapter 110 are shown coupled together after insertion. Coupled transceiver 100 and adapter 110 are then preferably inserted into an evaluation board 210 of a tester 200, as shown in FIG. 4C, to obtain the configuration shown in FIG. 4D. In some instances, as shown in FIG. 4E, a spacer 140 may be used in order to provide support for the electrical adapter 110 and transceiver 100 by positioning the spacer 140 between the electrical adapter 110 and the evaluation board 210. When a spacer 140 is used, an electrical socket 220 (FIG. 4C) of the evaluation board 210 is coupled to an electrical interface 112 of an adapter 110 inside the opening 142 of the spacer 140.

Figure 5A:
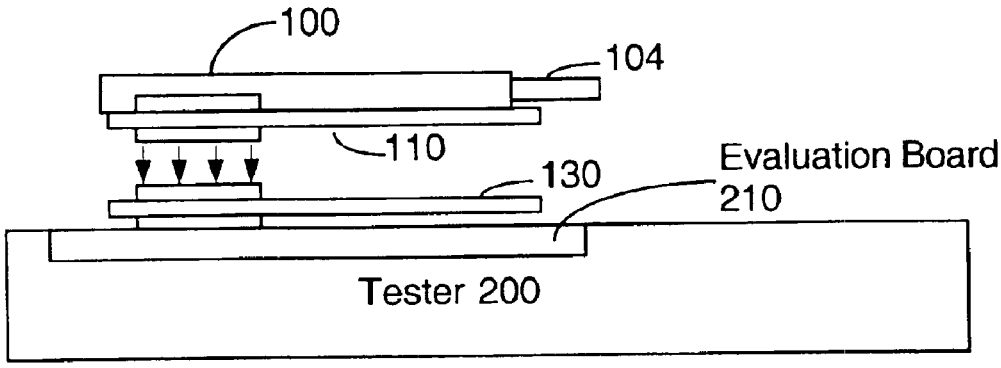
FIG. 5A is a side view of a transceiver and a first electrical adapter being coupled to a second electrical adapter and a tester.
Figure 5B:
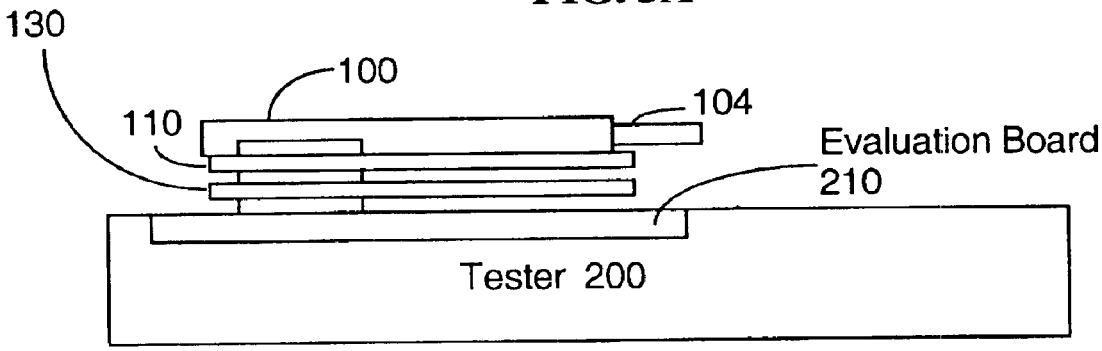
FIG. 5B is a side view of a transceiver, first electrical adapter, second electrical adapter, and tester coupled to one another.

FIG. 5A is a side view of a transceiver and a first electrical adapter being coupled to a second electrical adapter and a tester. To reduce damage to the electrical socket 220 (FIG. 4C) of the evaluation board 210 of the tester 200, as well to prevent damage to the electrical socket 132 of a transceiver 100, two adapters, first adapter 10 and second adapter 130, may be used, as is shown in FIG. 5A. Second adapter 130 is preferably identical to the first adapter 110 in all respects. In this case, the first electrical adapter 110 is coupled to a transceiver 100 as shown in FIGS. 4A and 4B. A second electrical adapter 130 is then coupled to the evaluation board 210 of the tester 200 by coupling the electrical interface 114 (FIG. 2B) of the adapter 110 to the electrical socket 220 (FIG. 4C) of the evaluation board 210 of the tester 200. Once coupled, the second electrical interface 114 (FIG. 2B) of the first adapter 110 is then coupled to the complementary electrical interface 116 (FIG. 2A) of the second adapter 130. The tester 200, transceiver 100, and two adapters 110 and 130 will then be configured as shown in FIG. 5B.

Figure 6:
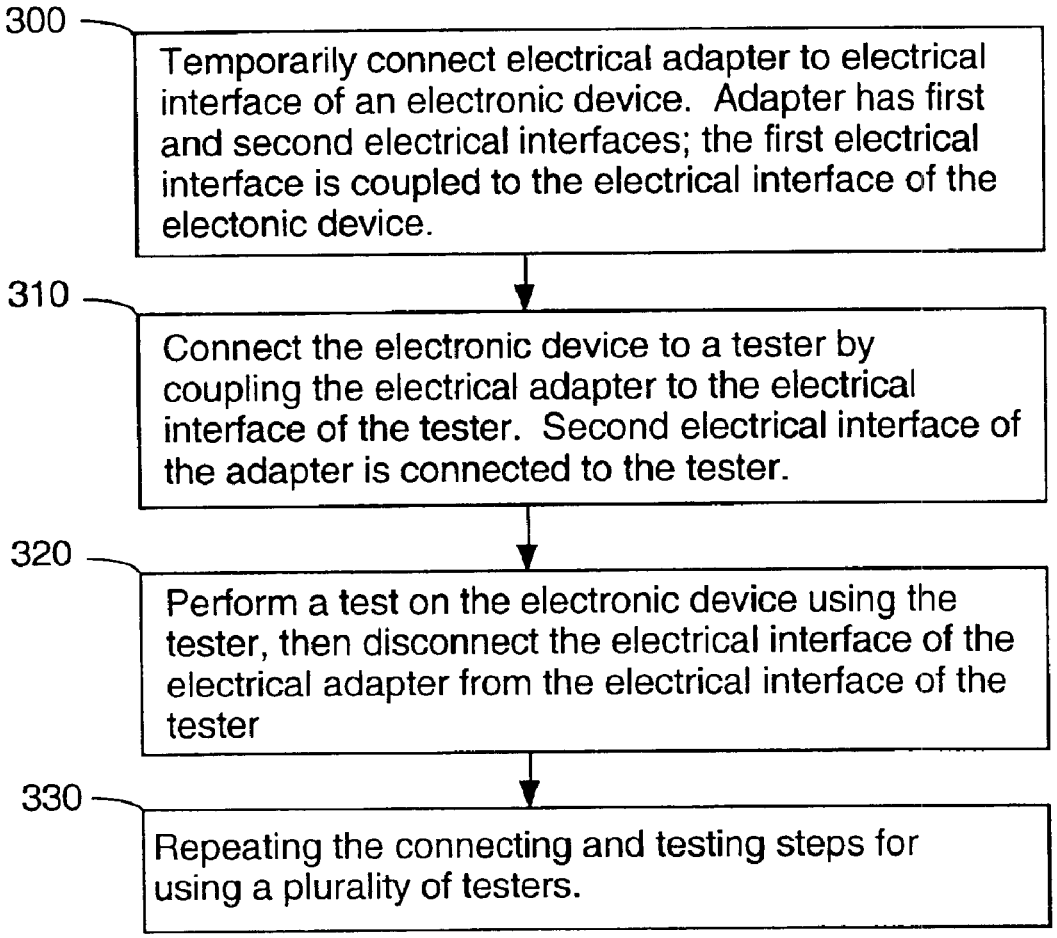
FIG. 6 is a flow chart of a method for testing an electrical device having an electrical interface.

FIG. 6 is a flow chart of a method for testing an electrical device 100 (FIG. 1) using an adapter 110 having an electrical interface 112 (FIG. 2A) and/or 114 (FIG. 2B). Through the use of a single connection of an electrical interface 112 of an adapter 110, shown in FIG. 2A, to a corresponding electrical socket 132 of, for example, a transceiver 100, damage to an electrical socket 132 of a transceiver 100 or other electrical device may be reduced considerably.

At step 300, an electrical adapter 110 (FIGS. 4A and 4B) is temporarily connected to an electrical socket 132 (FIG. 1) of an electrical device 100 (FIG. 1). At step 310, electrical device 100 (FIG. 1) is then connected to tester 200 (FIG. 4C) by coupling the electrical adapter 110 (FIG. 4C) to the electrical socket 220 (FIG. 4C) of the tester 200 (FIG. 4C). The second electrical interface 114 (FIG. 4B) of the adapter is coupled to tester 200 (FIG. 4C). At step 320, a test is then performed on the electrical device 100 (FIG. 4C) using the tester 200 (FIG. 4C). The electrical interface 114 (FIG. 2B) of the electrical adapter 110 FIG. 4A) is then disconnected from the electrical socket 220 FIG. 4C) of the tester 200 (FIG. 4C). Lastly, at step 330, the three steps 300, 310, and 320 are repeated for a variety of testers.

Figure 7:
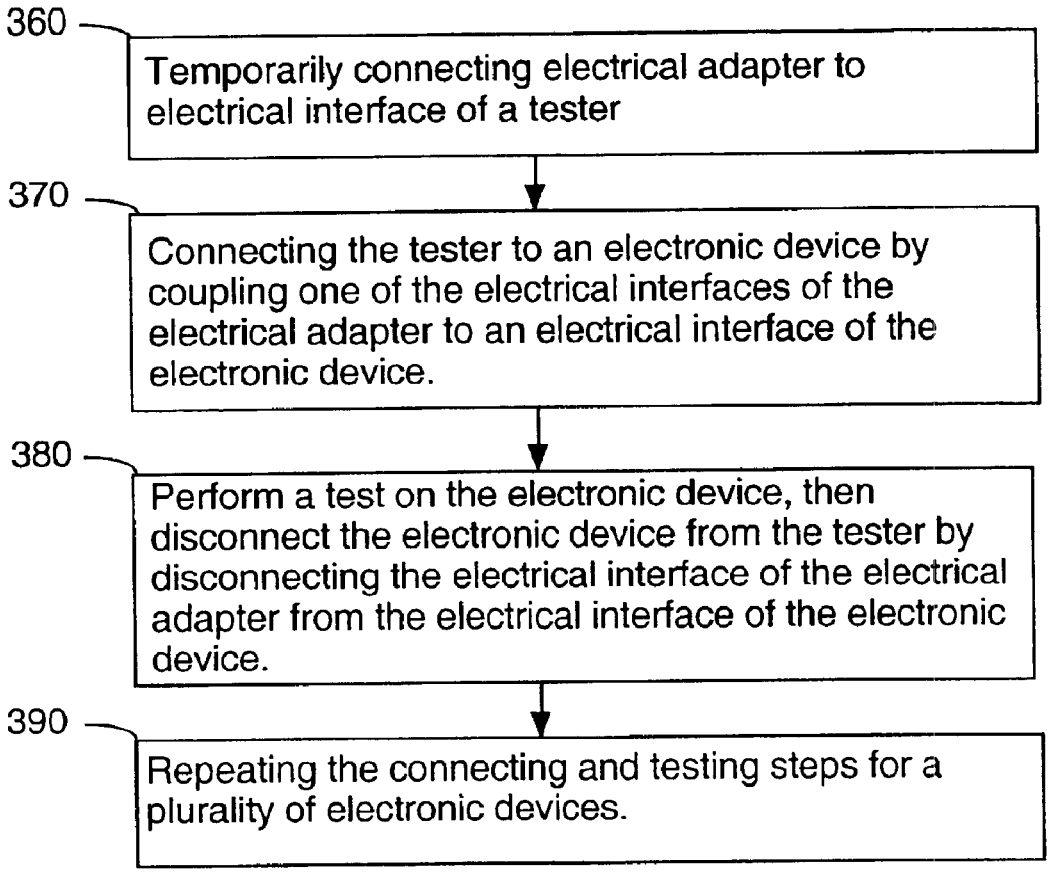
FIG. 7 is a flow chart of a method for testing electrical devices using a tester.

FIG. 7 is a flow chart of a method for testing electrical devices 100 (FIG. 1) using a tester (FIG. 4C). Through the use of a single connection of an electrical interface 114 (FIG. 2B) of an adapter 110 (FIG. 4C) to a corresponding electrical socket 220 (FIG. 4C) of an evaluation board 210 (FIG. 4C) of a tester 200 (FIG. 4C), damage to electrical socket 220 (FIG. 4C) of an evaluation board 210 (FIG. 4C) of a tester may be reduced considerably.

At step 360, an adapter 110 (FIG. 4C) is connected to an electrical socket 220 (FIG. 4C) of an evaluation board 210 (FIG. 4C) of a tester 200 (FIG. 4C). At step 370, the tester 200 (FIG. 4C) is then connected to an electrical device 100 (FIG. 4C) by temporarily coupling one of the electrical interfaces 112 (FIG. 2A) or 114 (FIG. 2B) of the electrical adapter 110 (FIG. 4C) to an electrical socket 132 (FIG. 1) of the electrical device 100 (FIG. 4C). At step 380, a test is then performed on the electrical device 100 (FIG. 4C), then the electrical device 100 (FIG. 4C) is disconnected from the tester 200 (FIG. 4C) by disconnecting the electrical interface 112 (FIG. 2A) of the electrical adapter 110 (FIG. 4C) from the electrical interface 134 (FIG. 1) of the electrical device 100 (FIG. 4C). Lastly, at step 390, the steps 360, 370, and 380 are repeated for a variety of testers.

As such, methods are provided for testing a particular electrical device against a plurality of distinct testers. The adapter is connected to a particular electrical device and temporarily connected a plurality of testers to run different tests on the same electrical device without damaging the pins or electrical connection of the particular electrical device. Thus, the electrical device, after the series of testing, is provided with longer lifetime rating.

Similarly, methods are provided for using a tester with a plurality of distinct electrical devices. That is, the adapter can be connected to a single tester and temporarily connected to a plurality of different electrical devices to run the same test on a large number of devices without damaging the pins or electrical connection of the single tester.

The adapters of the present invention are useful to test an electrical device regardless of the lifetime rating of the device. However, the present invention is useful for those the electrical devices having low lifetime ratings, e.g., less than 100 insertions and removals from corresponding complementary electrical interfaces on external electrical devices.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An electrical adapter configured to be used in testing electrical devices, the electrical adapter comprising:

a board having first and second opposing planar surfaces;

a male electrical socket coupled to the first planar surface of the board, the male electrical socket comprising a plurality of blades and being configured to interface with a corresponding electrical connector of a first electrical device; and a female electrical socket coupled to the second planar surface of the board, the female electrical socket comprising a plurality of pairs of leaf pins and being configured to interface with a corresponding electrical connector of a second electrical device;

the board including electrical connectors electrically coupling the male and female electrical sockets to each other.

2. The electrical adapter of claim 1, further comprising a spacer that defines an aperture having a size substantially corresponding to a size of at least one of the male and female electrical sockets.

3. The electrical adapter of claim 1, wherein the male electrical socket is configured to prevent insertion of a male electrical interface into the male electrical socket.

4. The electrical adapter of claim 1, wherein the female electrical socket is configured to prevent insertion of a female electrical interface into the female electrical socket.

5. The electrical adapter of claim 1, wherein the male and female electrical sockets are configured to prevent insertion of an electrical interface of wrong gender.

6. The electrical adapter of claim 1, wherein the blades in the male electrical socket are electrically coupled to the electrical connectors in the board by a ball grid array.

7. The electrical adapter of claim 1, wherein the board is a printed circuit board.

8. The electrical adapter of claim 1, wherein the male electrical socket is configured to removably engage the corresponding electrical connector of the first electrical device.

9. The electrical adapter of claim 1, wherein the female electrical socket is configured to removably engage the corresponding electrical connector of the second electrical device.

10. The electrical adapter of claim 1, wherein each blade of the male electrical socket is configured to removably engage a pair of leaf pins.

11. The electrical adapter of claim 1, wherein each pair of leaf pins of the female electrical socket is configured to removably engage a blade.

12. The electrical adapter of claim 1, wherein at least one of the electrical adapter male and female sockets is configured to interface with an electrical device that comprises an Integrated DWDM Transponder for OC-192/STM-64.

* * * * *

UNITED STATES PATENT AND TRADEMARK OFFICE

CERTIFICATE OF CORRECTION

PATENT NO. : 6,887,109 B2
APPLICATION NO. : 10/695346
DATED : May 3, 2005
INVENTOR(S) : Hofmeister et al.

It is certified that error appears in the above-identified patent and that said Letters Patent is hereby corrected as shown below:

Column 1,
Line 33, after "wider and shorter" remove "pin"

Column 3,
Line 29, after "FIG. 1 illustrates" remove "is"

Column 5,
Line 56, after "first adapter" change "10" to --110--

Column 6,
Line 25, after "using a tester" insert --200--
Line 50, after "temporarily connected" insert --to--
Line 54, before "longer lifetime rating." insert --a--
Line 64, before "electrical devices" remove "the"

Signed and Sealed this

Thirty-first Day of July, 2007

JON W. DUDAS
*Director of the United States Patent and Trademark Office*